US007078863B2

(12) United States Patent
Ide et al.

(10) Patent No.: US 7,078,863 B2
(45) Date of Patent: Jul. 18, 2006

(54) COLD-CATHODE ELECTRON SOURCE AND FIELD-EMISSION DISPLAY

(75) Inventors: Tetsuya Ide, Kanagawa (JP); Junichi Sawahata, Mie (JP); Masao Urayama, Saitama (JP)

(73) Assignee: Sharp Kabushiki Kaisha, Osaka (JP)

( * ) Notice: Subject to any disclaimer, the term of this patent is extended or adjusted under 35 U.S.C. 154(b) by 375 days.

(21) Appl. No.: 10/381,477

(22) PCT Filed: Sep. 27, 2001

(86) PCT No.: PCT/JP01/08465

§ 371 (c)(1),
(2), (4) Date: Dec. 31, 2003

(87) PCT Pub. No.: WO02/27745

PCT Pub. Date: Apr. 4, 2002

(65) Prior Publication Data

US 2004/0085009 A1 May 6, 2004

(30) Foreign Application Priority Data

Sep. 28, 2000 (JP) ..... 2000-296787

(51) Int. Cl.
*G09G 3/10* (2006.01)

(52) U.S. Cl. ..... 315/169.1; 315/169.3; 315/382; 313/495; 313/497; 313/336

(58) Field of Classification Search ..... 315/169.1, 315/169.3, 169.4, 382; 313/495–498, 309, 313/310, 336, 412, 414
See application file for complete search history.

(56) References Cited

U.S. PATENT DOCUMENTS

| | | | | |
|---|---|---|---|---|
| 5,552,659 | A | 9/1996 | Macaulay et al. | 313/310 |
| 5,981,305 | A * | 11/1999 | Hattori | 438/20 |
| 6,437,503 | B1 | 8/2002 | Konuma | 313/495 |
| 6,563,260 | B1 * | 5/2003 | Yamamoto et al. | 313/495 |
| 2004/0090172 | A1 * | 5/2004 | Ide et al. | 313/497 |

FOREIGN PATENT DOCUMENTS

| | | |
|---|---|---|
| JP | 5-282990 | 10/1993 |
| JP | 7-029484 | 1/1995 |
| JP | 9-306396 A | 11/1997 |
| JP | 2000-156147 | 6/2000 |
| JP | 2000-243218 A | 9/2000 |

OTHER PUBLICATIONS

Uemura et al; "39.3: Carbon Nanotube Fed Elements"; Ise Electronics Corp., Ise, Japan, 1998; 1052-1055.

(Continued)

*Primary Examiner*—Haissa Philogene
(74) *Attorney, Agent, or Firm*—Nixon & Vanderhye, P.C.

(57) ABSTRACT

A cold-cathode electron source having an improved utilization efficiency of an electron beam and a simple structure. The cold-cathode electron source comprises a gate electrode (4) provided on a substrate (2) through an insulating layer (3) and an emitter (6) extending through the insulating layer (3) and the gate electrode (4) and disposed in an opening of the gate. During the emission of electrons from the emitter (6), the following relationships are satisfied: 10 [V/μm]≧(Va−Vg)/(Ha−Hg)≧Vg/Hg; and Vg/Hg [V/μm]≧Va×$10^{-4}$×(9.7−1.3×ln(Hg))×$(1000/Ha)^{0.5}$, where Ha [μm] is an anode-emitter distance, Va [V] is an anode-emitter voltage, Hg [μm] is a gate-emitter distance, and Vg [V] is a gate-emitter voltage.

15 Claims, 11 Drawing Sheets

OTHER PUBLICATIONS

Translation of the International Preliminary Examination Report mailed Jun. 13, 2003 in corresponding PCT application No. PCT/JP01/08465.

Supplementary European Search Report mailed Feb. 4, 2005 in corresponding EP application No. 01970252.

Su et al, "Electrical and Thermal Modeling of a Gated Field Emission Triode", Electron Devices Meeting, 1993, Technical Digest, Int'l. Washington, DC, Dec. 5-8, 1993, New York, NY, IEEE, pp. 765-768.

* cited by examiner

FIG.11

| | ANODE VOLTAGE (kV) | ANODE-EMITTER DISTANCE (mm) | ANODE-EMITTER ELECTRIC FIELD STRENGTH (μm) | GATE OPENING SIZE (μm) | GATE HEIGHT TO GATE SIZE RATIO | GATE FILM THICKNESS (μm) | ELECTRIC FIELD STRENGTH AT MINIMUM BEAM SPOT SIZE (V/μm) | GATE-EMITTER ELECTRIC FIELD STRENGTH REGION SATISFYING BEAM SPOT SIZE≤GATE OPENING SIZE (V/μm) | GATE-EMITTER ELECTRIC FIELD STRENGTH REGION SATISFYING BEAM SPOT SIZE≤(2×GATE OPENING SIZE) (V/μm) |
|---|---|---|---|---|---|---|---|---|---|
| REGION 2 | 1 | 0.2 | 5 | 20 | 1:1 | 10 | 3 | 1~4.9 | — |
| | 1 | 0.2 | 5 | 20 | 3:5 | 10 | 3 | 2.1~5 | 1.5~5 |
| | 2.5 | 0.5 | 5 | 20 | 1:1 | 10 | 3 | 1.8~4 | 1.5~5 |
| | 2.5 | 0.5 | 5 | 20 | 3:5 | 10 | 3 | 2.2~4.5 | 1.8~5 |
| REGION 3 | 5 | 1 | 5 | 20 | 1:1 | 10 | 3 | 2.5~4.5 | 2.1~5 |
| | 5 | 1 | 5 | 20 | 3:5 | 10 | 4 | 3.5~5 | 3.3~5 |
| REGION 1 | 7.5 | 1 | 7.5 | 20 | 1:1 | 10 | 4.5 | 3.7~6 | 3.1~7.5 |
| | 7.5 | 1 | 7.5 | 20 | 3:5 | 10 | 7.5 | None (7.5, ratio:1.25) | 5~7.5 |
| | 10 | 1 | 10 | 20 | 1:1 | 10 | 6 | 5~7.5 (7.5 is calculation upper-limit) | 4.2~7.5 (7.5 is measurement upper-limit) |
| | 10 | 1 | 10 | 20 | 3:5 | 10 | 10 | None (10, ratio: 1.24) | — |
| | 7.5 | 1.5 | 5 | 20 | 1:1 | 10 | 4 | 3.5~4.75 | 3.3~5 |
| | 7.5 | 1.5 | 5 | 20 | 3:5 | 10 | 5 | None (5, ratio: 1.27) | 3.7~5 |
| | 10 | 1.5 | 6.7 | 20 | 1:1 | 10 | 5 | 4.5~6.5 | 4~6.7 |
| | 15 | 1.5 | 10 | 20 | 1:1 | 10 | 7.5 | 7~9 | 6.3~10 |
| | 15 | 1.5 | 10 | 20 | 3:5 | 10 | 10 | None (10, ratio: 1.26) | — |
| | | | | | | | | | |
| REGION 2 | 1 | 0.2 | 5 | 3 | 1:1 | 0.5 | 3 | 2.1~5 | 1.7~5 |
| | 1 | 0.2 | 5 | 3 | 3:5 | 0.5 | 3 | 2.5~3.5 | 2~4.2 |
| | 2.5 | 0.5 | 5 | 3 | 1:1 | 0.5 | 4 | 3~4.3 | 2.3~5 |
| REGION 3 | 5 | 1 | 5 | 3 | 1:1 | 0.5 | 4 | None (4, ratio: 1.77) | 3.5~4.75 |
| | 5 | 1 | 5 | 3 | 3:5 | 0.5 | 4 | None (4, ratio: 1.8) | 3.75~4.75 |
| REGION 1 | 7.5 | 1 | 7.5 | 3 | 1:1 | 0.5 | 7.5 | None (7.5, ratio: 2.26) | None (7.5, ratio: 2.26) |
| | 7.5 | 1 | 7.5 | 3 | 3:5 | 0.5 | 5 | None (5, ratio: 1.84) | 4.9~6 |
| | 10 | 1 | 10 | 3 | 1:1 | 0.5 | 7.5 | None (7.5, ratio: 1.78) | 7~9 |
| | 10 | 1 | 10 | 3 | 3:5 | 0.5 | 7.5 | None (7.5, ratio: 1.84) | 7~9 |
| | 7.5 | 1.5 | 5 | 3 | 1:1 | 0.5 | 4 | None (4, ratio: 2.49) | None (4, ratio: 2.49) |
| | 7.5 | 1.5 | 5 | 3 | 3:5 | 0.5 | 4 | None (4, ratio: 2.43) | None (4, ratio: 2.43) |
| | 10 | 1.5 | 6.7 | 3 | 1:1 | 0.5 | 5 | None (5, ratio: 2.61) | None (5, ratio: 2.61) |
| | 15 | 1.5 | 10 | 3 | 1:1 | 0.5 | 7.5 | None (7.5, ratio: 2.58) | None (7.5, ratio: 2.58) |
| | 15 | 1.5 | 10 | 3 | 3:5 | 0.5 | 7.5 | None (7.5, ratio: 2.53) | None (7.5, ratio: 2.53) |

COLD-CATHODE ELECTRON SOURCE AND FIELD-EMISSION DISPLAY

This application is the US national phase of international application PCT/JP01/08465 filed 27 Sep. 2001, which designated the US.

TECHNICAL FIELD

The present invention relates to a cold cathode electron source, particularly to a cold cathode electron source capable of improving electron beam utilization efficiency, and a field emission display employing the electron source.

BACKGROUND ART

Electron emission includes field electron emission, secondary electron emission, and photoelectric emission, as well as thermionic emission. A cold cathode is the cathode that performs electron emission by field electron emission, which occurs due to a tunnel effect when a strong electric field ($10^9$ V/m) is applied to the vicinity of the surface of a substance to lower the potential barrier on the surface.

The cold cathode does not require heating as does the hot cathode. Its current-voltage characteristics can be approximated by the Fowler-Nordheim equation. The electron emission portion, to which a strong electron field is applied while maintaining insulation, is structured (e.g., a needle structure) so as to increase the electric field concentration constant.

Early cold cathodes are of a diode tube structure employing a needle-like single crystal such as a whisker that is polished by electrolytic polishing. Recently, microfabrication techniques in integrated circuit or thin film technologies have resulted in significant advances in the manufacture of field emission electron sources (field emitter arrays) that emit electrons in a high electric field. Thus, electric field emission cold cathodes with extremely minute structures are now being manufactured.

This type of field emission cold cathode is the most fundamental electron emission device of all the major components of a ultra-small triode electron tube or an ultra-small electron gun. Structural miniaturization has resulted in such an advantage that the device can provide a higher current density than the hot cathode as an electron source.

Field emission displays (FEDs) using the cold cathode are expected to find applications in self-emissive flat panel displays, and research and development of electric field emission electron sources are actively underway.

The operation of and methods of manufacturing the electric field emission electron source have been disclosed in a research report by C. A. Spindt et al. of the Stanford Research Institute, which was published in the Journal of Applied Physics, Vol. 47, No. 12, pp. 5248–5263 (1976); in U.S. Pat. No. 3,665,241 issued to C. A. Spindt et al.; and in U.S. Pat. No. 4,307,507 issued to H. F. Gray et al.

The electric field emission electron sources known from the above publications are all equipped with a protruding electron emission portion, which is formed on a semiconductor or metal substrate. Around the emitter is formed a gate for applying an electric field to draw electrons. Electrons which are emitted from the emitter by applying voltage to the gate travel to an anode formed above the emitter, as shown in FIG. 8(*a*).

In these cold-cathode electron sources, a high electric field is applied between the gate and the emitter so that the emitter can emit electrons, and a positive voltage is applied to the anode so that it can collect the emitted electrons. This resulted in the problem of spreading of the emitted electrons, due to the fact that the anode-gate electric field is weaker than the gate-emitter electric field.

In recent years, electron sources for depletion-mode electron emission apparatus have been proposed, as disclosed in Japanese Patent Laying-open Publication (Unexamined Application) No. 5-282990, for example. In these types of electron sources, a material, such as diamond, that emits electrons in low electric field is used in the emitter, and electrons are drawn from the emitter by applying a voltage to the anode, while using the gate electrode for controlling the emission of electrons.

Japanese Patent Laying-open Publication (Unexamined Application) No. 2000-156147 discloses a cold-cathode electric field emission device including an anode, gate and emitter. With this device, electrons are emitted by an electric field between the anode and the emitter, and the electron beam is focused by an electric field between the gate and the emitter. The area of the gate opening is larger than that of the bottom portion of the gate. The publication also describes the conditions of isoelectric lines irrespective of the structure.

Various materials for the electric-field emission electron source that is used in FEDs are known. Conventional materials require an electric field intensity of 1000 V/μm as an effective value to obtain sufficient electron emission. Thus, a value on the order of 100 V/μm is obtained for the intensity of an actually applied electric field by the above-mentioned structure to increase the electric field concentration constant.

Carbon materials such as carbon nanotubes are also gaining attention as electron emission materials, for they have been confirmed to emit electrons with an extremely small electric field intensity. Uemura et al. of Ise Electronics Corporation have proposed (in SID 98 DIGEST, pp. 1052–1055) an electric field emission electron source in which carbon nanotube is used in the emitter and with a gate electrode formed in the shape of a mesh or a grid, as shown in FIG. 8(*e*).

In the conventional cold-cathode electron source having a protruding electron emission portion, the spreading of electrons is prevented by providing a focus electrode such as shown in FIG. 8(*b*), as disclosed by Ito et al. of Futaba Corporation in Japanese Patent Laying-open Publication (Unexamined Application) No. 7-29484. This arrangement resulted in an increased number of manufacturing steps and complication of the device structure.

When a material that can easily emit electrons is used in the emitter, a sufficient amount of electrons can be emitted with an anode-emitter electric field. Thus, a depletion mode may be employed for operation, as in Japanese Patent Laying-open Publication (Unexamined Application) No. 5-282990. The depletion mode is a technique for controlling the emission of electrons from the emitter by applying an emission-suppressing voltage to the gate electrode, thus narrowing the passageway of electrons. Accordingly, there is no electron emission in an emitter region near the gate, and the strong electric field region is limited to the emitter near the gate hole center, as shown in FIG. 8(*c*), thus narrowing the region of the emitter where emission takes place and lowering the emitter utilization efficiency.

In Japanese Patent Laying-open Publication (Unexamined Application) No. 2000-156147, the gate electrode is used for focusing an electron beam. As the area of the gate opening is larger than the area of the bottom surface of the gate, as shown in FIG. 8(*d*), it is difficult to completely suppress the electric field from the anode. The production process is also complicated. The conditions regarding the isoelectric lines concern only general conditions about focusing, and an accurate analysis is not described.

In the example of SID 98 DIGEST, pp. 1052–1055, because it employs a mesh- or grid-like gate electrode as shown in FIG. 8(*e*), it is difficult to bring the gate electrode closer to the emitter. And because the emitter is present at locations other than the position immediately below the gate opening, the current flowing through the gate electrode increases. This results in reduced efficiency, for the electrons other than those reaching the anode electrode and allowing a phosphor to irradiate are wasted.

It is therefore an object of the invention to provide an inexpensive cold-cathode electron source capable of improving the utilization efficiency of an electron beam, which can be realized by a simple structure, and a field emission display utilizing the electron source.

SUMMARY OF THE INVENTION

A cold-cathode electron source according to the invention comprises a gate formed on a substrate via an insulating layer, and an emitter disposed at a gate opening portion provided through the insulating layer and the gate, the electron source satisfying, when electrons are emitted by the emitter:

$$10[\mathrm{V}/\mu\mathrm{m}] \geqq (Va-Vg)/(Ha-Hg) \geqq Vg/Hg; \text{ and}$$

$$Vg/Hg\ [\mathrm{V}/\mu\mathrm{m}] \geqq Va\times10^{-4}\times(9.7-1.3\times1n(Hg))\times(1000/Ha)^{0.5}$$

where Ha [μm] is an anode-emitter distance, Va [V] is an anode-emitter voltage, Hg [μm] is a gate-emitter distance, and Vg [V] is a gate-emitter voltage.

By satisfying Dg/Hg≦5/3, where Dg is the opening width of the gate opening portion, the emission of electrons from the emitter can be suppressed when the anode-gate electric field strength is greater than the gate-emitter electric field strength.

Further, by satisfying (Va−Vg)/(Ha−Hg)≈Vg/Hg when electrons are emitted from the emitter, the electrons emitted from the emitter travel substantially in parallel toward the anode, so that the electron beam can reach the anode with substantially the same size as that of the gate opening.

Further, by satisfying Dg/Hg≦2/1 where Dg is the opening width of the gate opening portion, the emission of electrons from the emitter can be suppressed when the anode-gate electric field strength is greater than the gate-emitter electric field strength.

In another aspect, the invention provides a field emission display in which the cold-cathode electron source is formed in the shape of a two-dimensional matrix.

In the cold-cathode electron source according to the invention, the anode-gate electric field is made stronger than the gate-emitter electric field, so that the electric fields are directed in a direction in which the electrons are focused, thus allowing the gate electrode to function as a focus electrode as well. This eliminates the need to provide a separate focus electrode and simplifies the manufacturing process, while preventing the electrons from being emitted toward the gate electrode when a plane-surfaced emitter is used.

Further, preferably, by satisfying $Vg/Hg\ [\mathrm{V}/\mu\mathrm{m}] \geqq Va\times10^{-4}\times(9.7-1.3\times1n(Hg))\times(1000/Ha)^{0.5}$, where Ha [μm] is an anode-emitter distance, Va [V] is an anode voltage, Hg [μm] is a gate-emitter distance, and Vg [V] is a gate voltage, the beam spot size on the anode surface can be prevented from becoming larger than the emitter area or the gate opening area, even if the converged electron beam is not focused on the anode surface.

Further, preferably, by providing conditions so that the spot size of the electron beam on arrival at the anode is not larger than the emitter area or the gate opening area until the luminance of a display pixel reaches 1/1000 of peak luminance, crosstalk can be prevented.

Further preferably, by producing the emitter with a material that emits electrons at an electric field strength of 10 V/μm or less, the breakdown of insulation due to discharge or the like can be prevented.

This specification includes part or all of the contents as disclosed in the specification and/or drawings of Japanese Patent Application No. 2000-296787, which is a priority document of the present application.

BRIEF DESCRIPTION OF THE DRAWINGS

FIG. 8(*a*) is a cross-sectional view of equipotential surfaces of a cold-cathode electron source using a cone-shaped emitter. FIG. 8(*b*) is a cross-sectional view of equipotential surfaces of a cold-cathode electron source using a focus electrode. FIG. 8(*c*) is a cross-sectional view of equipotential surfaces of a cold-cathode electron source using a depletion mode. FIG. 8(*d*) is a cross-sectional view of equipotential surfaces of a cold-cathode electron source using a focusing gate electrode. FIG. 8(*e*) is a cross-sectional view of equipotential surfaces of a cold-cathode electron source using a meshed gate. FIG. 8(*f*) is a cross-sectional view of equipotential surfaces of a cold-cathode electron source using a focusing gate electrode.

FIG. 11 is an illustrative view for illustrating the constitution of the electron source according to the first embodiment in which a circular gate opening is formed, fabricated and evaluated, the electric field strength at which the beam spot size becomes minimum, the gate-emitter electric field strength region where beam spot size≦gate opening size is satisfied, and the gate-emitter electric field strength region where beam spot size≦(2×gate opening size) is satisfied.

BEST MODE OF CARRYING OUT THE INVENTION

The preferred embodiments of the present invention will be described hereafter with reference to the attached drawings.

Figure 1:
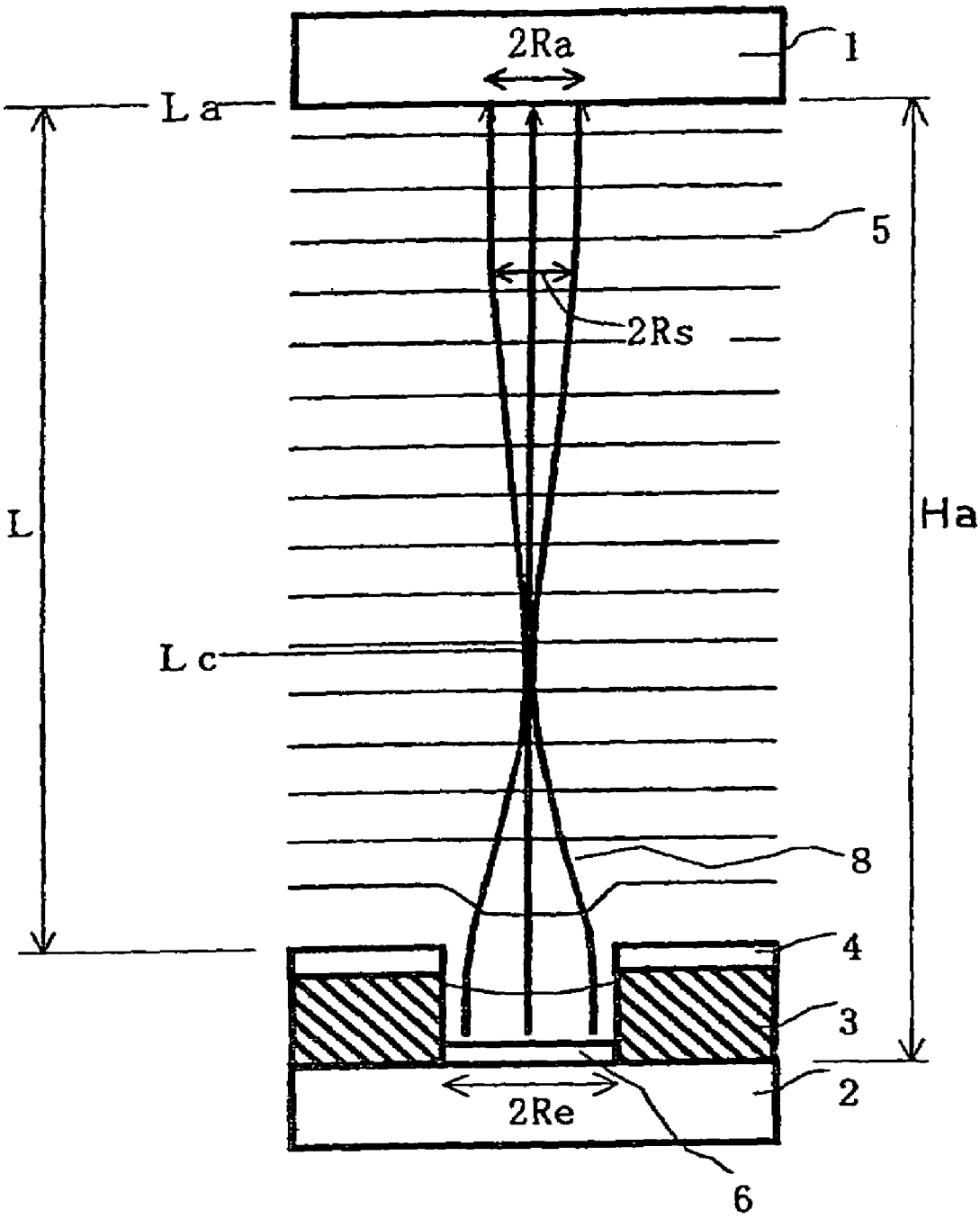
FIG. 1 is an illustrative view for illustrating an apparatus including a cold-cathode electron source according to a first embodiment of the invention and an anode electrode 1.

FIG. 1 is an illustrative view for illustrating an apparatus including a cold-cathode electron source 1 according to a first embodiment of the invention and an anode electrode.

The electron source has a layered structure made up of an insulating layer 3 formed on a substrate 2, and a gate electrode 4 formed on the insulating layer 3. An emitter 6 is formed on the substrate 2 in a hole (gate opening portion) formed through the insulating layer 3 and the gate electrode 4.

The emitter 6 is formed by screen-printing a commercially available calcined silver paste in which 10 wt % of carbon nanotube is dispersed. The emitter material is not limited to carbon nanotube and may be any material as long as it can provide a current density of the order of 10 mA/cm$^2$ with an electric field strength of less than 10 V/μm. Further, the means of forming the emitter is not limited to screen printing, either.

When the anode-gate electric field strength is greater than the gate-emitter electric field strength, if the size of the gate hole opening is large, electrons are emitted from the emitter 6 even when a gate voltage Vg is 0. Accordingly, it is desirable that the ratio of a gate opening width Dg (2Re) to a gate-emitter distance Hg in the present embodiment satisfies Dg/Hg≦5/3.

Next, the insulating layer 3 having a thickness of 20 μm is formed by screen printing and then the gate electrode 4 having a thickness of 5 μm is formed on the insulating layer. While in the present embodiment the gate is formed as a shape having a circular opening of 20 μmϕ, other shapes may be used, such as a waffle or a stripe shape.

The anode electrode 1 is formed by coating a phosphor P22 that is used in CRTs (cathode ray tubes) on a substrate and then forming a metal back on the phosphor.

In the case where a focus point is formed before the anode surface by the focusing effect of a gate voltage, the electron beam 8 forms a focus point Lc as shown in FIG. 1. The beam then spreads from the focus point conversely, to form a spot with a radius Ra at position La of the anode electrode 1.

Figure 2:
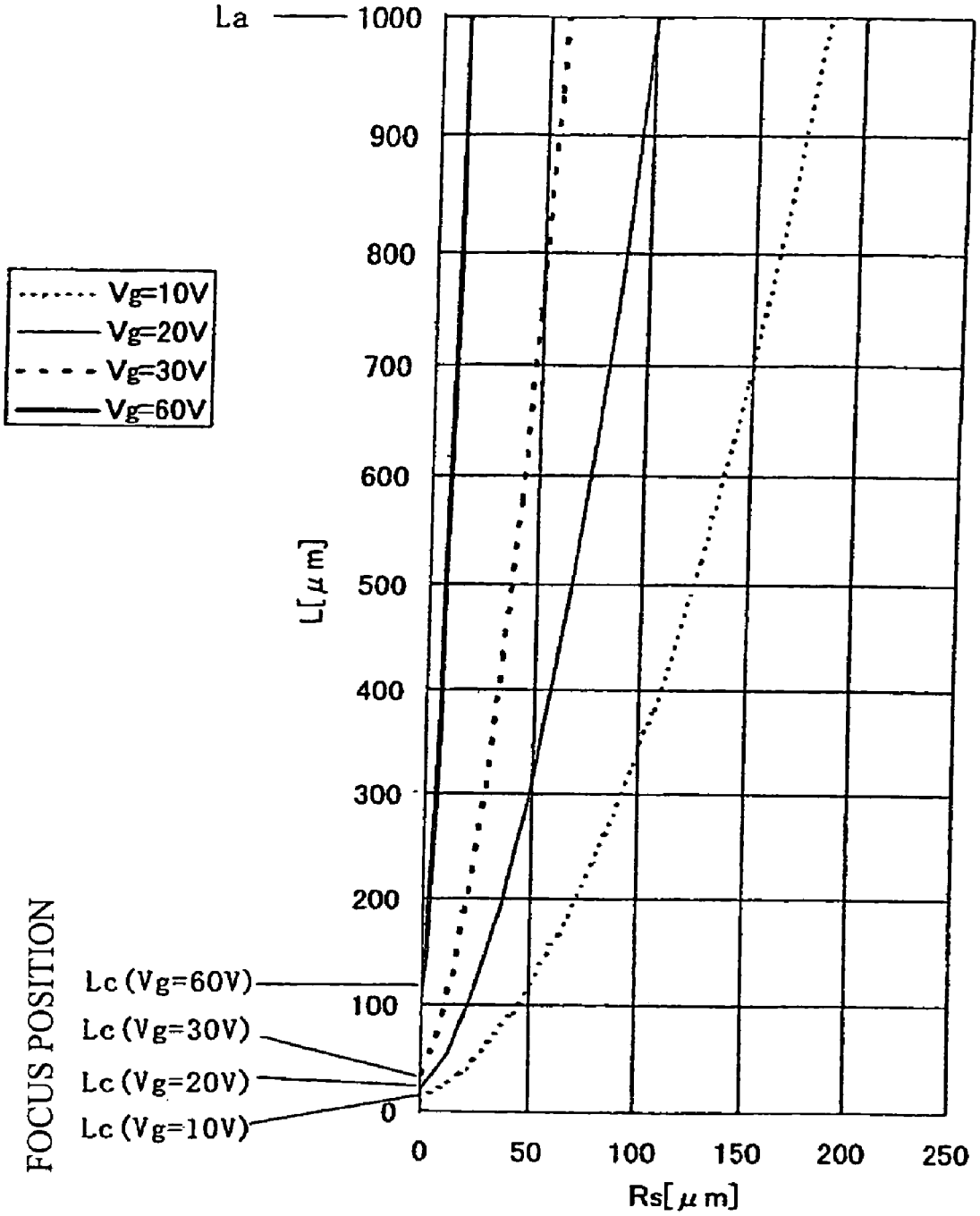
FIG. 2 is an illustrative view for illustrating the beam trajectory when a gate voltage Vg is varied from 5 to 60 V in the electron source according to the first embodiment of the invention where an anode voltage is 5000 V and an anode-emitter distance is 1000 μm.

FIG. 2 is a graph for illustrating the trajectory of the electron beam when the anode voltage is Va=5000 V, the anode-emitter distance is Ha=1000 μm, and the gate voltage is varied from 10 to 60 V in the present example of the electron source.

The beam trajectory is shown with the vertical and the horizontal axes corresponding to L and the beam spot radius Rs, respectively, of FIG. 1. The graph shows that when Vg<60 V the spot 2Ra spreads on the anode surface due to the spreading of the beam after passing the focus point Lc.

Figure 3:
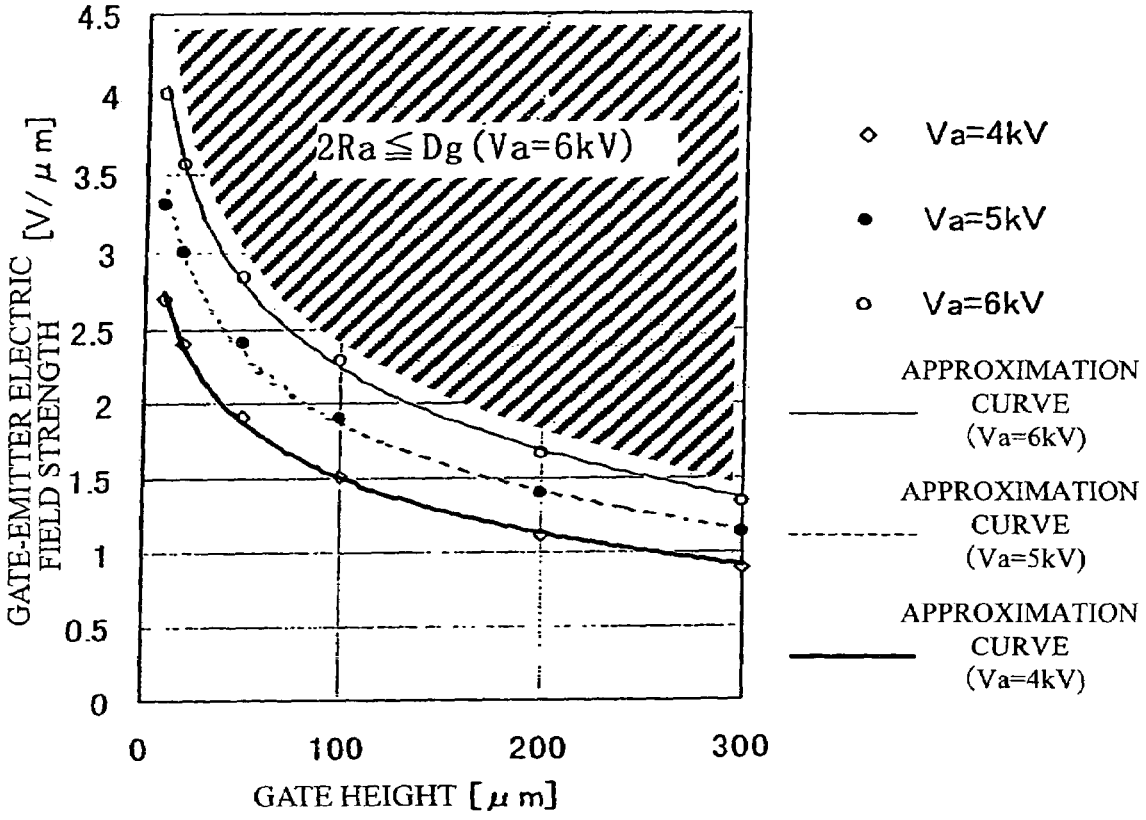
FIG. 3 is a diagram that plots a gate-emitter distance that satisfies 2Ra=Dg and a gate-emitter electric field strength in the electron source according to the first embodiment of the invention when the gate-emitter distance is varied between 50 to 250 μm.

FIG. 3 is a diagram that plots the gate-emitter distance satisfying 2Ra=Dg and the gate-emitter electric field strength when the gate-emitter distance is varied from 50 to 250 μm in the electron source of the present example.

Here, a gate having an opening width Dg of 20 μm is on an insulating sheet with a thickness of 50 μm formed by a 20 μmϕ-boring process. A gate electrode is formed on top of the insulating sheet, which is then stacked on the emitter 6. The graph plots the relationship between the gate height and the gate-emitter electric field strength under the condition that 2Ra=Dg is satisfied between the beam spot 2Ra on the anode surface and the gate opening width Dg, when the gate height is varied from 10 to 300 μm.

The amount of variation can be logarithmically approximated. The region above the approximate curve is the region where the beam spot 2Ra on the anode surface is smaller than the gate opening width Dg, and it is desirable to select an arrangement where this condition is met.

When the gate opening width and the emitter-anode distance are constant, similar effects can be obtained at a lower electric field strength by increasing the gate height. While this is advantageous for maintaining the gate-emitter insulation, this is not preferable from the drive viewpoint, as it results in a higher operating voltage.

Considering the above, the fact that the withstand voltage in a vacuum gap is generally 10 kV/μm, and also the fact that when Vg/Hg is greater than (Va−Vg)/(Ha−Hg), the electron beam is diffused because of drawing of electrons by gate voltage, a conditional formula for preventing the spot size from spreading on the anode surface is derived as follows:

$$10[\mathrm{V/\mu m}] \geqq (Va-Vg)/(Ha-Hg)$$

$$\geqq Vg/Hg$$

$$\geqq Va\times10^{-4}\times(9.7-1.3\times1n(Hg))\times(1000/Ha)^{0.5} \quad (1)$$

In the present embodiment, the above conditional formula is satisfied by selecting the anode voltage Va=5000 V, the anode-emitter distance Ha=1000 μm, the gate height Hg=20 μm, and the gate voltage Vg=60 V. The anode voltage is selected to enable sufficient electron transmittance and emission luminance to be obtained by the phosphor P22 on which the metal back is formed, and the gate height is selected to facilitate the formation of the gate by screen printing. However, this constitution is only exemplary.

By setting the area of the emitter formed on the bottom surface of the gate opening portion to be 64% of the area of the bottom surface, and by locating the emitter at the center of the gate opening portion, the gate voltage Vg can be lowered from 60 to 40 V without changing the spot size on the anode surface.

Figure 4:
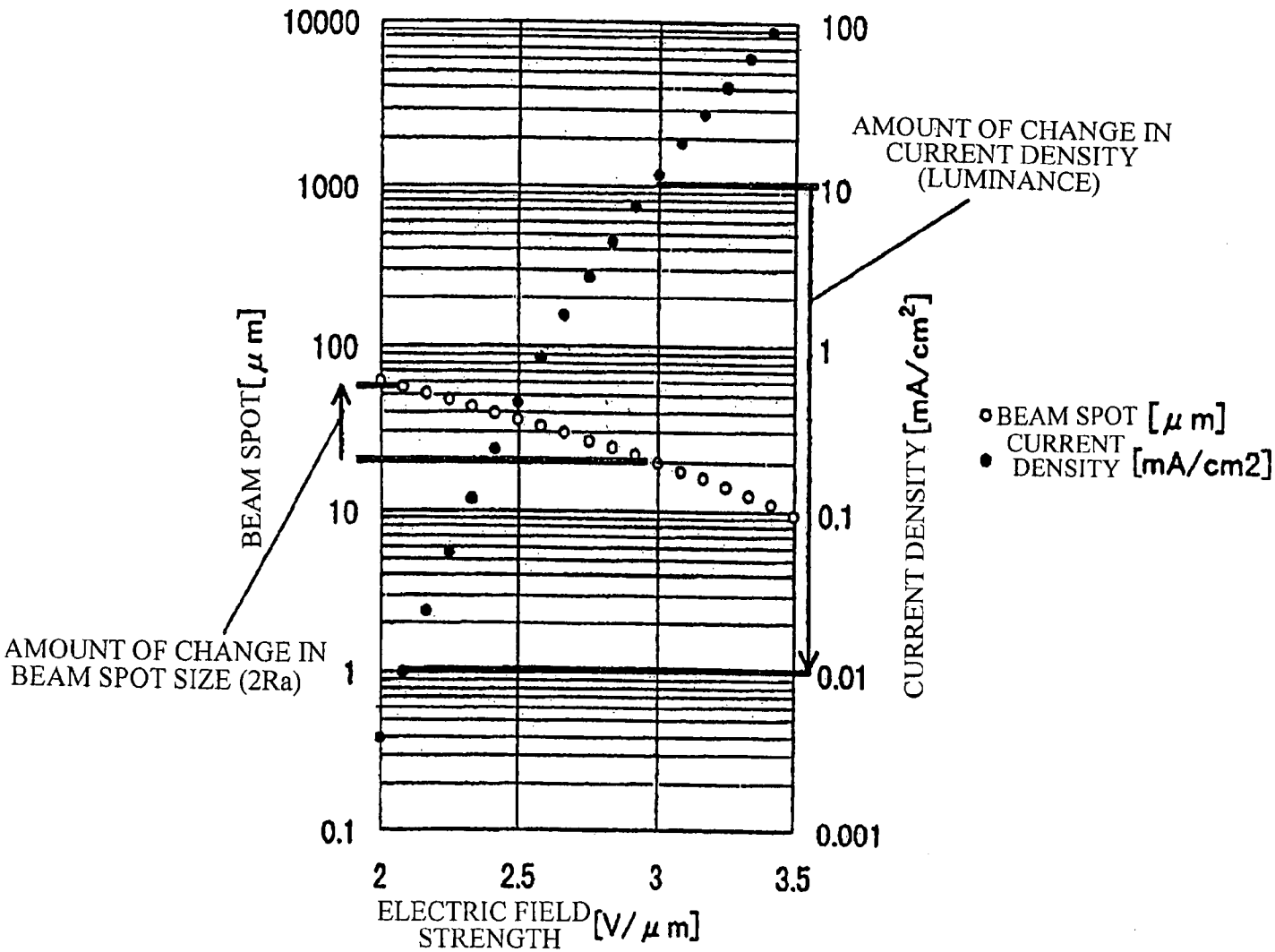
FIG. 4 is a diagram that plots the gate-emitter electric field strength and changes in the beam spot and the current density in the electron source according to the first embodiment of the invention.

FIG. 4 is a diagram that plots the gate-emitter electric field strength and the changes in the beam spot and the current density in the electron source according to the present example.

This example uses a carbon nanotube emitter that enables the emission with the current density of 10 mA/cm$^2$ to be obtained with a 3 V/μm electric field strength, and the changes in the beam spot and the current density as the gate voltage is varied are plotted against the electric field strength on the horizontal axis.

When the electric field strength is 2.5 V/μm, the spot size increases by 1.75 times, but the current density decreases to about 4% of that with the current density of 3 V/μm. Since the luminance is substantially proportional to the current density, crosstalk is not conspicuous in this state. By varying the gate voltage Vg between 60 to 40 V, the amount of emitted electrons can be controlled, so that, when used in an FED, gradation can be obtained.

Next, an example where the gate opening is square-shaped and the emitter width 2Re is smaller than the gate opening width Dg will be described.

Figure 9:
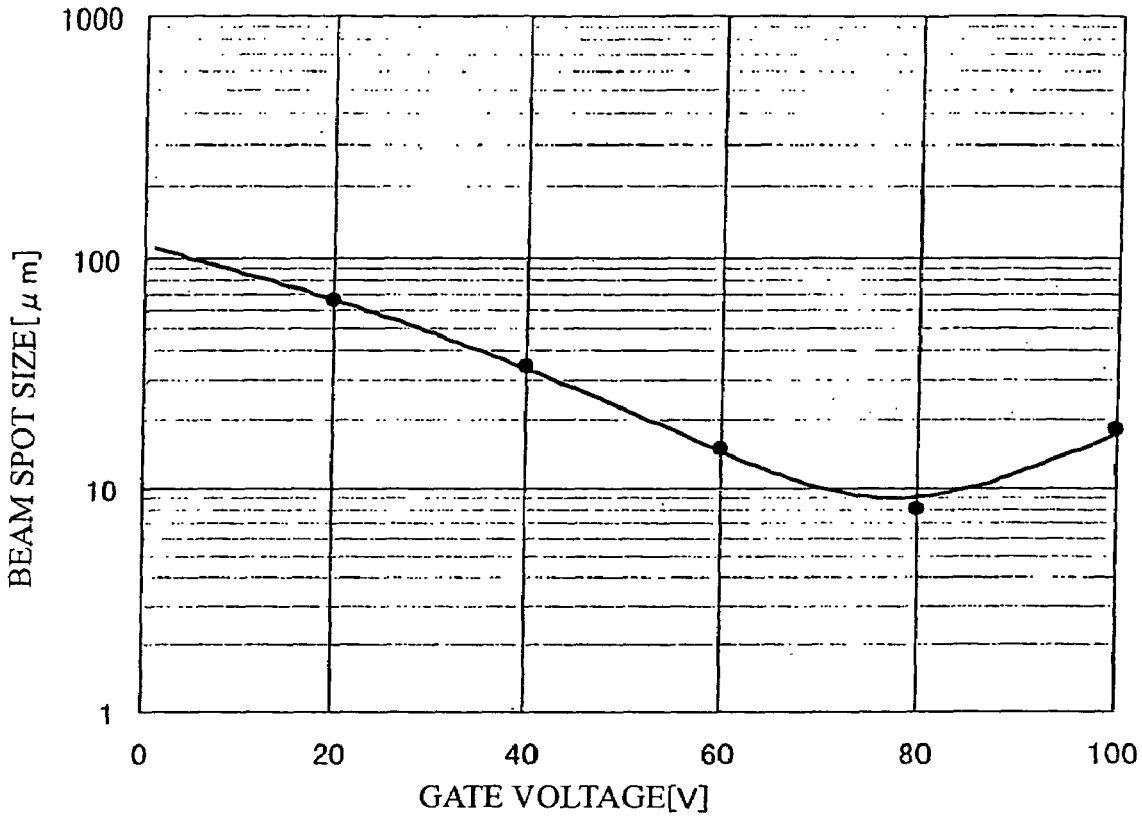
FIG. 9 is an illustrative view for illustrating the beam spot size when the gate voltage is varied between 20 and 100 V in the electron source according to the first embodiment of the invention, where the anode voltage is 5000 V, the anode-emitter distance is 1000 μm, the gate opening width is 20 μm, the emitter width is 16 μm, the gate-emitter distance is 20 μm, and the gate thickness is 10 μm.

FIG. 9 is a diagram that plots the spot size (2Ra) of the electron beam at the anode when the anode voltage is Va=5000 V, the anode-emitter distance is Ha=1000 μm, the gate-emitter distance is Hg=20 μm, the gate opening width is Dg=20 μm, the emitter width is 2Re=16 μm, the gate thickness is 10 μm, and the gate voltage is varied from 20 to 100 V in the electron source according to the present example.

In this case, the spot size (2Ra) can be approximated by the following equation:

$$(2Ra)=0.017\times Vg^2-2.7\times Vg+112$$

In this case, while the spot size is doubled when the gate voltage is Vg=35 V (gate-emitter electric field strength Eg=1.75 V/μm), the current density is about 4% of that with the gate voltage Vg=52 V (gate-emitter electric field strength Eg=2.6 V/μm). Since the luminance is substantially proportional to the current density, crosstalk is not so conspicuous in this state. By varying the gate voltage Vg between 52 and 35 V, the amount of emitted electrons can be controlled, so that, when used in an FED, gradation can be obtained.

Further, the operating voltage can be lowered in the range of variation between 60 and 40 V of the gate voltage Vg in the case that the emitter width 2Re is equal to the gate opening width Dg.

Next, an example where the gate-emitter distance is further reduced and the emitter width 2Re is smaller than the gate opening width Dg will be described.

In this case, the gate insulating film is formed by a sol-gel process, and the gate opening is formed by patterning by an exposure apparatus. The method of making the gate insulating film is not limited to the sol-gel process. For example, the film may be made by laminating an insulating film, or by applying and patterning photosensitive polyimide. The method is not particularly limited.

Figure 10:
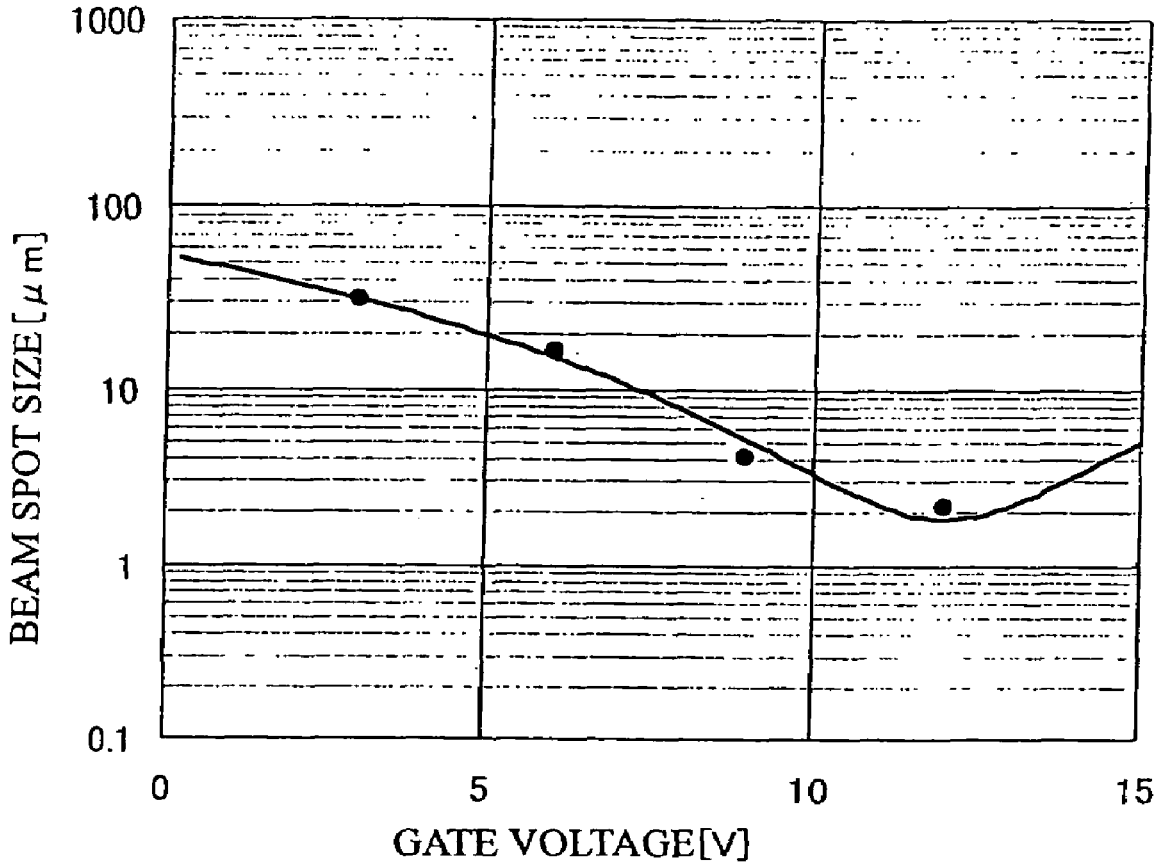
FIG. 10 is an illustrative view for illustrating the beam spot size as the gate voltage is varied between 3 and 15 V in the electron source according to the first embodiment of the invention, where the anode voltage is 5000 V, the anode-emitter distance is 1000 μm, the gate opening width is 3 μm, the emitter width is 2.6 μm, the gate-emitter distance is 3 μm, and the gate thickness is 0.5 μm.

FIG. 10 is a diagram that plots the spot size (2Ra) of the electron beam at the anode when the anode voltage is Va=5000 V, the anode-emitter distance is Ha=1000 μm, the gate-emitter distance is Hg=3 μm, the gate opening width is Dg=3 μm, the emitter width is 2Re=2.6 μm, the gate thickness is 0.5 μm, and the gate voltage is varied from 3 to 15 V in the electron source according to the present example.

In this case, the spot size (2Ra) can be approximated by the following equation:

$$(2Ra)=0.36\times Vg^2-8.7\times Vg+54.2$$

In this case, while the spot size increases by 1.3 times, when the gate voltage is Vg=9 V (gate-emitter electric field strength Eg=3 V/μm), the current density is about 4% of that with the gate voltage Vg=14 V (gate-emitter electric field strength Eg=4.7 V/μm). Since the luminance is substantially proportional to the current density, crosstalk is not so conspicuous in this state. By varying the gate voltage Vg between 14 and 9 V, the amount of emitted electrons can be controlled, so that, when used in an FED, gradation can be obtained.

Further, the operating voltage is 14 V in this case so that the existing driver can be used, thus contributing to reduction of the cost of the drive circuitry.

In the case where the emitter width 2Re is equal to the gate opening width Dg, the spot size is quadrupled when the gate voltage Vg is varied between 14 and 9 V. Thus, crosstalk can be reduced by making the emitter width 2Re smaller than the gate opening width Dg.

Further, for the same amount of change of spot size, the range of change of the gate voltage Vg can be 10 to 6.7 V, so that the operating voltage can be lowered.

Next, an example where the gate opening is circular shaped will be described.

FIG. 11 shows the constitution of the electron source that is fabricated and evaluated, the electric field strength minimizing the beam spot size, the gate-emitter electric field strength region satisfying the relationship of beam spot size≦gate opening size, and the gate-emitter electric field strength region satisfying the relationship of beam spot size≦(2×gate opening size).

The beam spot size herein refers to the beam spot size on the anode (phosphor) surface. The gate-emitter electric field strength refers to the gate voltage/(gate-emitter distance). The anode-emitter electric field strength refers to the anode voltage/(anode-emitter distance).

When there is no gate-emitter electric field strength region satisfying the relationship of beam spot size≦gate opening size, a notation "none" is given, together with the value of the electric field strength with which a minimum beam spot size can be obtained, and the corresponding value of beam spot size/gate opening size.

In region 1 of FIG. 11 luminance can be easily ensured by allowing the spacer height to be up to 1.5 mm and raising the anode voltage. Further, as the amount of current necessary for ensuring luminance decreases, extension of the electron source lifespan can be expected.

The region 2 of FIG. 11 is suitable for an FED utilizing a low-energy electron beam excitation phosphor, or a vacuum fluorescent display (VFD). In this region, a wide region of the gate-emitter electric field strength can be taken without resulting in the spreading of the beam spot, so that the electron emitting material can be selected from a wide range of alternatives.

The constitution of the FED using a high-energy electron beam excitation phosphor may be adapted if in the future improvements of luminance in low-voltage regions are made by the improvement of high-energy electron beam excitation phosphors (such as P22 for CRTs).

The region 3 of FIG. 11 indicates the gate-emitter electric field region suitable for the constitution of the current FEDs.

The electron source in each constitution is preferably used in a gate-emitter electric field strength region that satisfies the relationship of beam spot size≦gate opening size. Particularly, by using the electron source in a region that is higher than the electric field strength with which the beam spot is minimized, the spreading of the beam spot when the emission current is decreased (when the applied voltage is decreased) can be prevented.

While it is preferable to use the electron source in a gate-emitter electric field strength region that satisfies the relationship of beam spot size≦gate opening size, the electron source can be used in a wider gate-emitter electric field strength region when the area of the pixel region on the anode side is larger than the emitter-formed region.

For example, if the beam spot size can be permitted to be up to twice the gate opening size, the gate-emitter electric field strength region that satisfies beam spot size≦(2×gate opening size) shown in FIG. 11 can be used.

Particularly, when the gate is close to the emitter as in the case of the gate opening size of 3 μm, if the anode-emitter distance is more than 1 mm, it is difficult to make the beam spot size smaller than the gate opening size. In order to lower the drive voltage, it is desirable to make the pixel size larger than the emitter size so as to permit the beam spot size to be four to five times the gate opening size.

When the gate height to gate size ratio is 3:5, the film thickness of the gate insulating layer can be minimized while enabling the control of the emission current, so that fabrication can be facilitated.

When the gate height to gate size ratio is 1:1, the spreading of the beam spot can be suppressed, compared with the case that the gate height to gate size ratio is 3:5.

By using the drive method utilizing the electron source according to the present example, the electric field can be directed to the direction in which the electrons are focused, and the spreading of the electrons can be suppressed by a simple structure. Further, the electrons are emitted by the entire emitter, so that the emitter area utilization efficiency can be improved.

Figure 5:
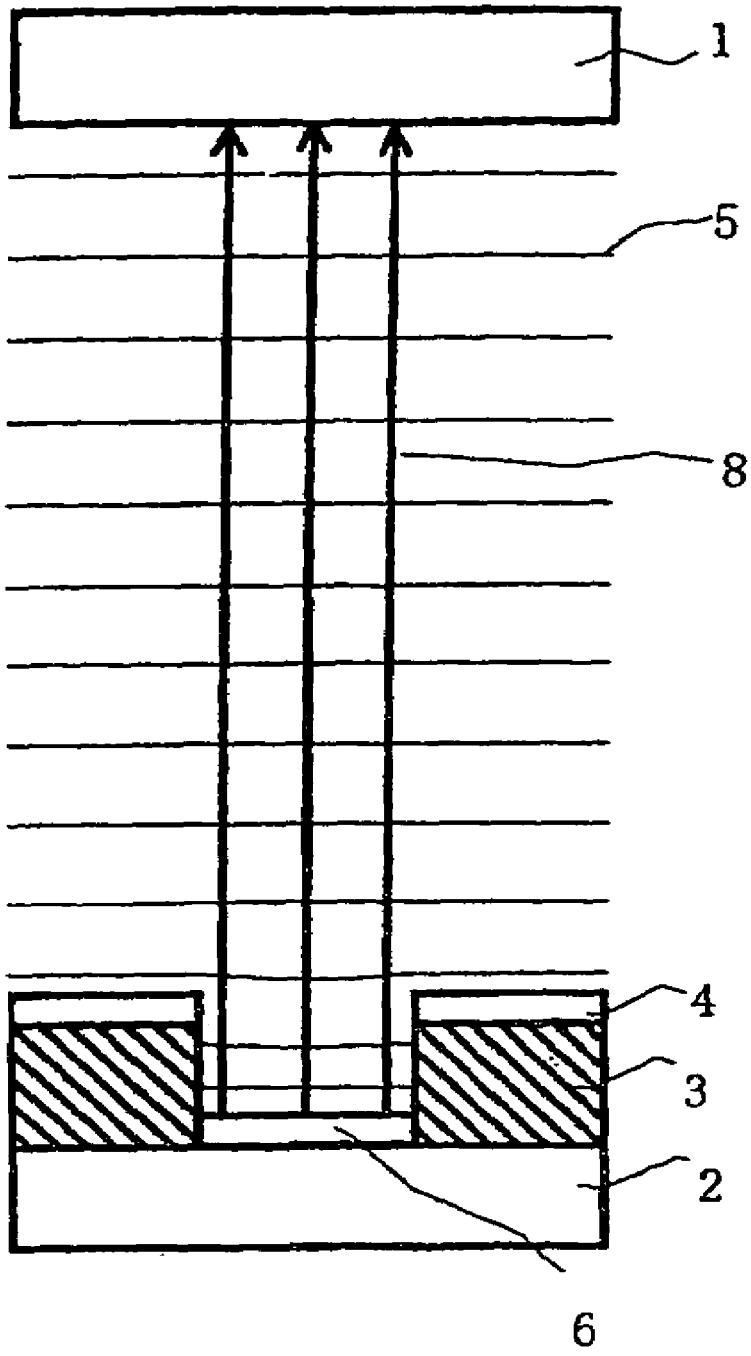
FIG. 5 is an illustrative view for illustrating an apparatus including a cold-cathode electron source according to a second embodiment of the invention and an anode electrode 1.

FIG. 5 is an illustrative view for illustrating an apparatus made up of a cold-cathode electron source according to a second embodiment of the invention and an anode electrode 1. Elements or parts similar to those in the above-described first embodiment are referenced by similar numerals and are not described.

The electron source has a layered structure including an insulating layer 3 formed on a substrate 2, and a gate electrode 4 formed on the insulating layer 3. An emitter 6 is formed on the substrate 2 within a hole provided through the insulating layer 3 and the gate electrode 4.

In the present embodiment, the electron source is driven with such a gate voltage that the anode-gate electric field is substantially equal to the gate-emitter electric field in accordance with the following equation:

$$10[\text{v}/\mu\text{m}] \geqq (Va-Vg)/(Ha-Hg)=Vg/Hg \geqq 0 \quad (2)$$

which corresponds to equation (1).

For example, when the anode-gate distance is extended in an FED in view of withstand voltage such that the anode voltage is Va=5 kV, and the anode-gate distance is (Ha−Hg) =1.7 mm. In this case, the anode-gate electric field is 3.0 V/μm.

If the gate opening size is large, the electric field from the anode enters the emitter plane even when the gate voltage Vg is 0, thus allowing the emitter to emit electrons. Thus, in the present embodiment, the ratio of the gate opening width Dg to the distance Hg between the gate upper end to the emitter desirably satisfies $Dg/Hg \leqq 2/1$.

Under this condition, the electric field from the anode entering the emitter plane when the gate voltage Vg is 0 can be suppressed below 30%, so that electrons are not emitted by solely the electric field from the anode. In the electron source according to the first embodiment, the amount of convergence of electrons is varied by voltage so that the electron beam spot size varies, the spot size further varying depending on the anode-gate distance. In the present embodiment, as the electrons travel substantially in parallel toward the anode, the electron beam reaches the anode with substantially the same size as the gate opening size, irrespective of the anode-emitter distance.

Figure 7:
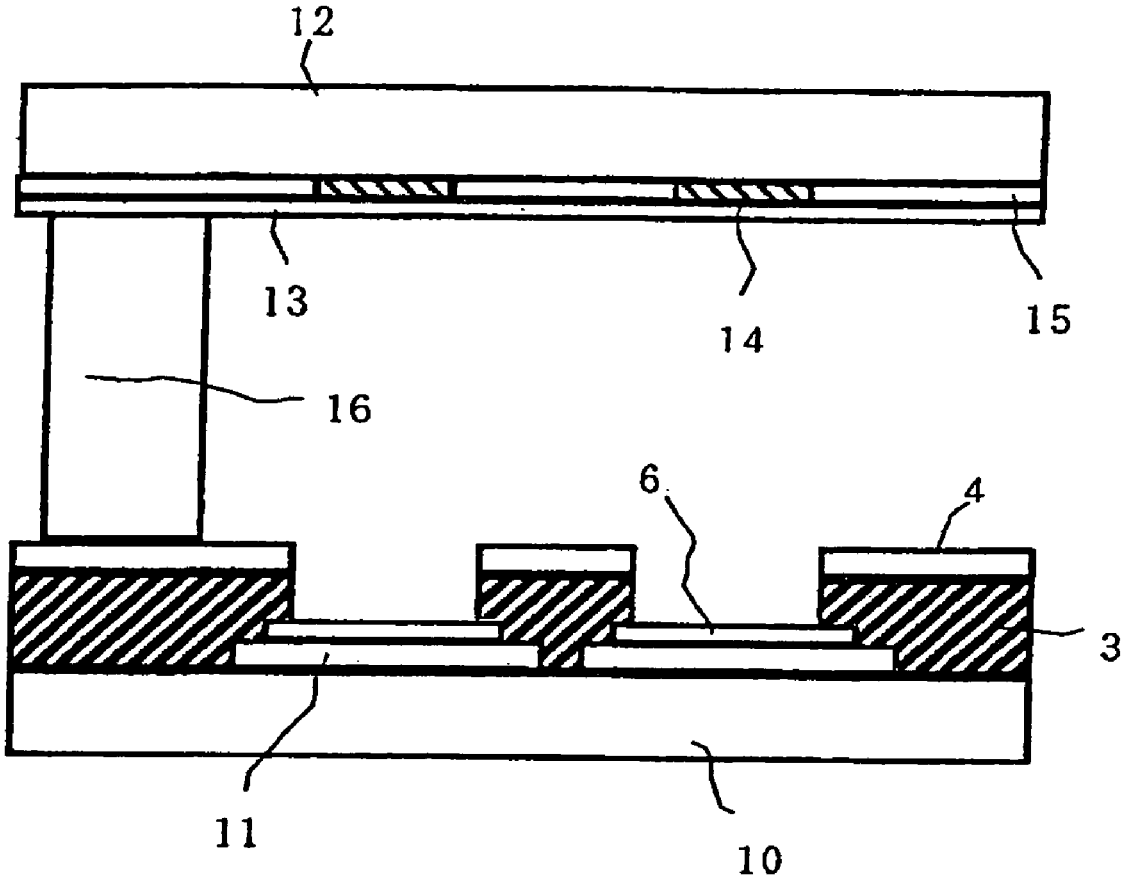
FIG. 7 is a cross-sectional view of a third embodiment of the invention.
Figure 8:
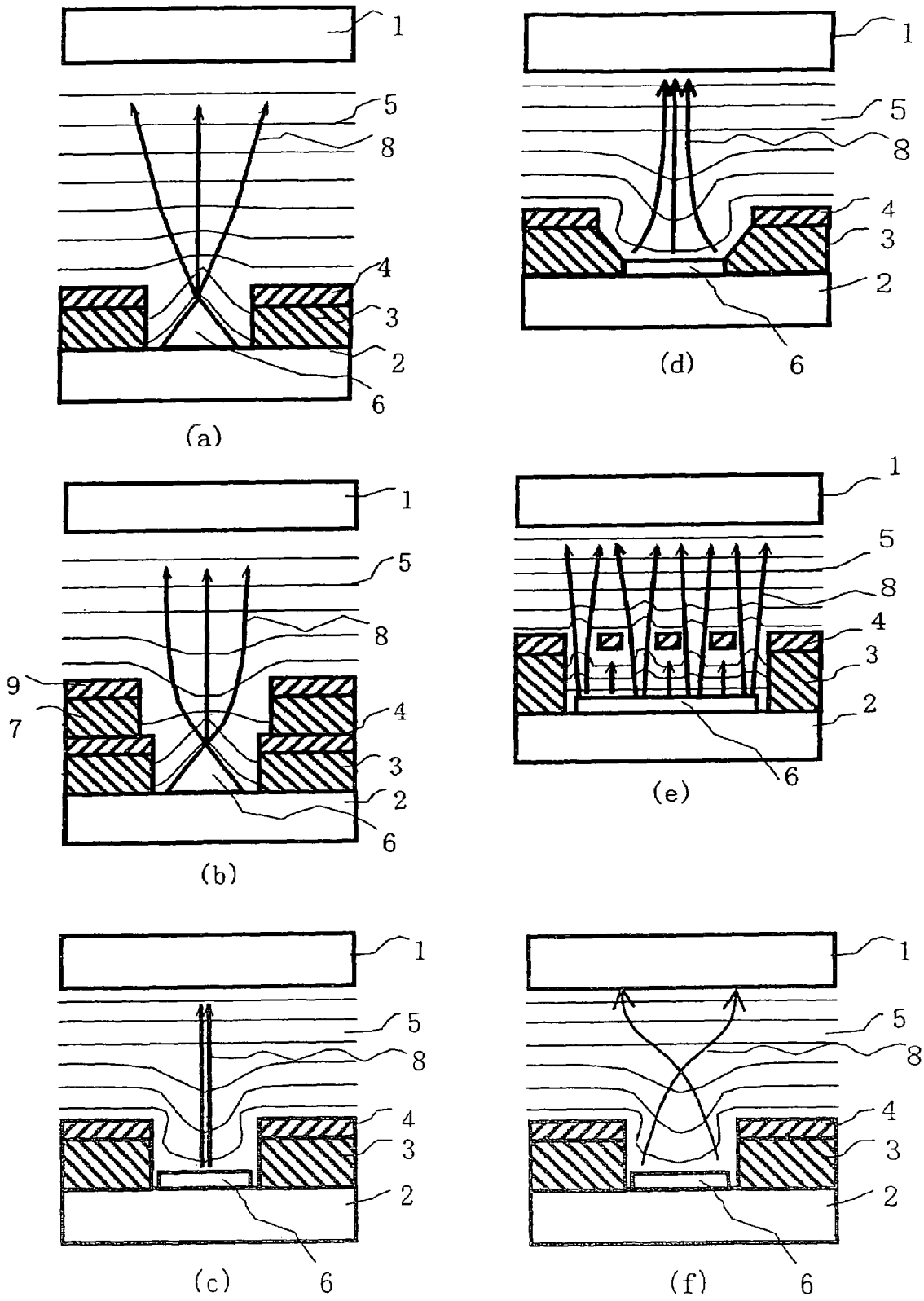
FIG. 8 is a illustrative view for illustrating the prior art.

FIG. 7 is an illustrative view for illustrating an FED configured by arranging the electron sources according to the first and second embodiments in a matrix. Elements or parts similar to those of the first or second embodiment are designated by similar numerals and are not described.

The FED shown in FIG. 7 includes a cathode panel (the entire structure disposed on a rear plate 10) having the above-mentioned electron source corresponding to each of the pixels arranged in a two-dimensional matrix, and an anode panel (the entire structure disposed on a face plate 12) having a phosphor layer which emits light when hit and excited by electrons emitted by electric field emission from the electron source. The cathode panel and the anode panel are joined by a spacer 16.

In the present embodiment, the face plate 12 and the rear plate 10 are made of glass substrates, while a phosphor 14 disposed on a black matrix 15 is made of P22 as in a CRT.

While a gate electrode 4 and a cathode line 11 are formed by depositing niobium by evaporation, other metals may be used. The wiring may be formed by sputtering or screen printing instead of by evaporation.

While carbon nanotubes are used as the material for an emitter 6, any substance, such as diamond, that can emit electrons with a low electric field may be used.

Figure 6:
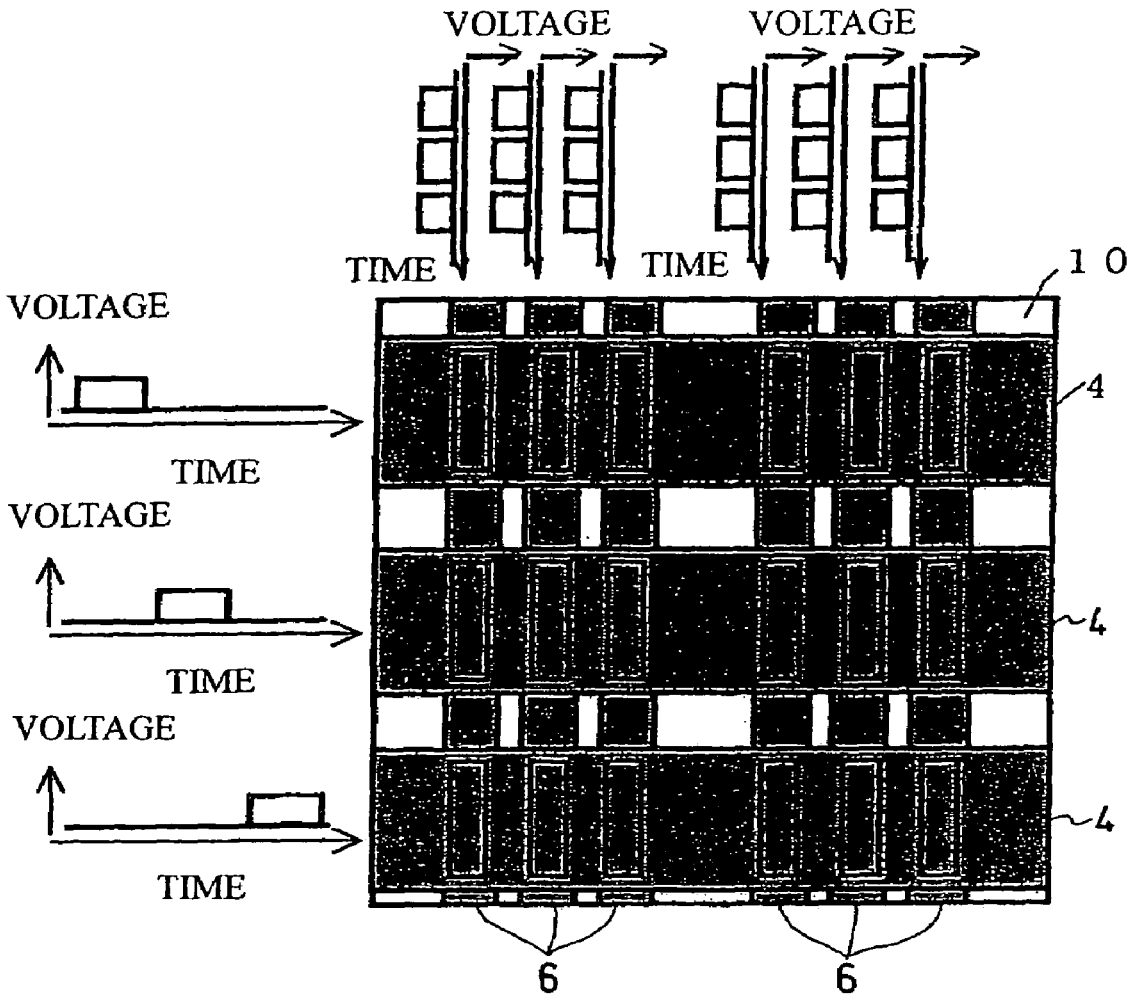
FIG. 6 is a diagram of an electron source array in which the cold-cathode electron source of the invention is utilized.

FIG. 6 is an illustrative view for illustrating how the FED of FIG. 7 is driven.

In the illustrated FED, six emitter lines 6 are formed on the rear plate 10, and a pulse voltage applied to each of the emitter lines 6 is shown. Further, three gate lines 4 are formed in such a manner as to be substantially perpendicular to the six emitter lines. A pulse voltage applied to each of the gate lines is shown.

The FED is driven by sequentially scanning gate line voltage, and varying the emitter line voltages. Specifically, a pulse voltage is applied to each of the gate lines from first to third stages, and electrons are emitted in the direction of the anode (not shown) in response to the individual emitter line voltage, resulting in irradiation at a predetermined location of the phosphor layer. While in this example gradation is realized by changing the voltage of the emitter 6, gradation may be realized by changing the width of the voltage pulse to the emitter line while fixing the emitter voltage.

In the present embodiment, one emitter 6 is used for each phosphor 14. However, a plurality of emitters may be employed for each phosphor 14. While in the present embodiment the drive method is used for sequentially operating the gate lines, cathode lines may be sequentially driven instead.

By thus driving the FED, an equipotential surface 5 is always protruding towards or parallel to the emitter 6 near the gate, as shown in FIG. 1 or 5. As the electrons are subjected to forces in a direction perpendicular to the equipotential surface 5, the electrons travel toward the anode while being focused or in parallel. Thus, the electrons emitted by the emitter can be easily focused, which can be realized by a simple manufacturing step.

In accordance with the invention, a drive method is employed in which the anode-gate electric field is stronger or at least equal to the gate-emitter electric field. As a result, the amount of electron beam can be controlled and the electron beam can be focused only by the gate electrode.

As the electrons are emitted by the entire emitter, the area utilization efficiency of the emitter can be increased.

Further, the spreading of the electrons can be suppressed by a simple structure without a focus electrode.

Further, as the area of the emitter fabricated at the bottom surface of the opening of the gate electrode is smaller than the bottom surface area, and because the emitter is located at the center of the gate opening, the drive voltage can be lowered.

Further, when the anode-gate electric field is equal to the gate-emitter electric field, the electrons travel in parallel. Accordingly, the size of the arriving electron beam is substantially the same regardless of the position of the anode, thus making it easier to design the structure of the FED.

Further, the emitter is plane-surfaced so that emission of electrons is not concentrated at any particular region, preventing the emitter from being easily damaged. As the electron-emitting region is large, more current can flow.

Further, by using a material that emits electrons at a low electric field, such as carbon nanotube, the anode-gate electric field necessary for the emission of electrons can be made stronger than the gate-emitter electric field.

Further, electrons do not spread and no crosstalk is generated even though the structure is simple and does not employ a focus electrode, making it possible to realize a field emission display in which electrons can efficiently strike the phosphor.

All publications, patents and patent applications cited herein are incorporated herein by reference in their entirety.

INDUSTRIAL APPLICABILITY

The invention can improve electron-beam utilization efficiency and provide a cold-cathode electron source that can be realized by a simple structure.

The invention claimed is:

1. A cold-cathode electron source comprising a gate formed on a substrate via an insulating layer, and an emitter disposed at a gate opening portion provided through the insulating layer and the gate, the electron source satisfying, when electrons are emitted by the emitter:

$$10\ [\mathrm{V/\mu m}] \geqq (Va-Vg)/(Ha-Hg) \geqq Vg/Hg;\ \text{and}$$

$$Vg/Hg\ [\mathrm{V/\mu m}] \geqq Va \times 10^{-4} \times (9.7-1.3 \times 1n(Hg)) \times (1000/Ha)^{0.5}$$

where Ha [μm] is an anode-emitter distance, Va [V] is an anode-emitter voltage, Hg [μm] is a gate-emitter distance, and Vg [V] is a gate-emitter voltage.

2. The cold-cathode electron source according to claim 1, further satisfying Dg/Hg≦5/3, where Dg is the opening width of the gate opening portion.

3. The cold-cathode electron source according to claim 1, further satisfying, when electrons are emitted by the emitter:

$$(Va-Vg)/(Ha-Hg) \approx Vg/Hg;\ \text{and}$$

Dg/Hg≦2/1, where Dg is the opening width of the gate opening portion.

4. A field emission display comprising the cold-cathode electron source according to claim 2, wherein the electron source is formed in the shape of a two-dimensional matrix.

5. A method of driving the cold-cathode electron source according to claim 3, wherein a relationship 5 [V/μm]≧Vg/Hg≧1.5 [V/μm] is satisfied, where Va≈1000 [V], Ha≈200 [μm], Dg≈20 [μm], and Hg≈12 [μm].

6. A method of driving the cold-cathode electron source according to claim 3, wherein a relationship 5 [V/μm]≧Vg/Hg≧1.8 [V/μm] is satisfied, where Va≈2500 [V], Ha≈500 [μm], Dg≈20 [μm], and Hg≈12 [μm].

7. A method of driving the cold-cathode electron source according to claim 3, wherein a relationship 5 [V/μm]≧Vg/Hg≧3.3 [V/μm] is satisfied, where Va≈5000 [V], Ha≈1000 [μm], Dg≈20 [μm], and Hg≈12 [μm].

8. A method of driving the cold-cathode electron source according to claim 3, wherein a relationship 7.5 [V/μm] ≧Vg/Hg≧5.0 [V/μm] is satisfied, where Va≈7500 [V], Ha≈1000 [μm], Dg≈20 [μm], and Hg≈12 [μm].

9. A method of driving the cold-cathode electron source according to claim 3, wherein a relationship 10 [V/μm]≧Vg/Hg is satisfied, where Va≈10000 [V], Ha≈1000 [μm], Dg≈20 [μm], and Hg≈12 [μm].

10. A method of driving the cold-cathode electron source according to claim 3, wherein a relationship 5 [V/μm]≧Vg/Hg≧3.7 [V/μm] is satisfied, where Va≈7500 [V], Ha≈1500 [μm], Dg≈20 [μm], and Hg≈12 [μm].

11. A method of driving the cold-cathode electron source according to claim 3, wherein a relationship 10 [V/μm]≈Vg/Hg is satisfied, where Va≈15000 [V], Ha≈1500 [μm], Dg≈20 [μm], and Hg≈12 [μm].

12. A method of driving the cold-cathode electron source according to claim 3, wherein a relationship 5 [V/μm]≈Vg/Hg≧2 [V/μm], where Va≈1000 [V], Ha≈200 [μm], Dg≈3 [μm], and Hg≈1.8 [μm].

13. A method of driving the cold-cathode electron source according to claim 3, wherein a relationship 5 [V/μm]≧Vg/Hg≧3.75 [V/μm] is satisfied, where Va≈5000 [V], Ha≈1000 [μm], Dg≈3 [μm], and Hg≈1.8 [μm].

14. A method of driving the cold-cathode electron source according to claim 3, wherein a relationship 7.5 [V/μm] ≧Vg/Hg≧4.9 [V/μm] is satisfied, where Va≈7500 [V], Ha≈1000 [μm], Dg≈3 [μm], and Hg≈1.8 [μm].

15. A method of driving the cold-cathode electron source according to claim 3, wherein a relationship 10 [V/μm]≈Vg/Hg≧7 [V/μm] is satisfied, where Va≈10000 [V], Ha≈1000 [μm], Dg≈3 [μm], and Hg≈1.8 [μm].

* * * * *